US006206709B1

(12) United States Patent
Uchiyama

(10) Patent No.: US 6,206,709 B1
(45) Date of Patent: Mar. 27, 2001

(54) HIGH VOLTAGE TERMINAL FOR AN IGNITION CABLE

(75) Inventor: Takehito Uchiyama, Yokkaichi (JP)

(73) Assignee: Sumitomo Wiring Systems, Ltd., Yokkaichi (JP)

( * ) Notice: Subject to any disclaimer, the term of this patent is extended or adjusted under 35 U.S.C. 154(b) by 0 days.

(21) Appl. No.: 09/440,086

(22) Filed: Nov. 15, 1999

(30) Foreign Application Priority Data

Nov. 16, 1998 (JP) ..... 10-325098

(51) Int. Cl.[7] ..... H01R 13/44
(52) U.S. Cl. ..... 439/125
(58) Field of Search ..... 439/125, 126, 439/127, 128, 840, 843, 846

(56) References Cited

U.S. PATENT DOCUMENTS

| | | | | |
|---|---|---|---|---|
| 5,340,323 | | 8/1994 | Imanishi et al. | 439/125 |
| 5,421,736 | | 6/1995 | Imanishi et al. | 439/125 |
| 5,813,872 | * | 9/1998 | Evans et al. | 439/125 |
| 5,951,308 | * | 9/1999 | Rea | 439/125 |

FOREIGN PATENT DOCUMENTS

| | | |
|---|---|---|
| 5-66891 | 9/1993 | (JP) . |
| 6-80295 | 11/1994 | (JP) . |

* cited by examiner

*Primary Examiner*—Tulsidas Patel
(74) *Attorney, Agent, or Firm*—Greenblum & Bernstein, P.L.C.

(57) ABSTRACT

There is provided a high voltage terminal for an ignition cable with which it is possible to easily mount and more accurately position a spring member which is accommodated in the terminal to provide a more reliable electrical connection with an ignition plug having a generally columnar terminal, such as an end terminal. A spring member is provided at its opposite ends with portions having a larger diameter than the diameter of the intermediate portion in the longitudinal direction thereof. When the spring member is disposed within a terminal of generally tubular shape, a C-ring member having a pair of projections is clipped onto the terminal to extend within apertures in the terminal. Each projection of the C-ring member projects into the terminal, so that the spring member is held within the terminal under the condition where the large diameter portion at one end of the spring member is fixed in position between a contact piece of the terminal and the projections of the C-ring member which project into the terminal.

9 Claims, 7 Drawing Sheets

HIGH VOLTAGE TERMINAL FOR AN IGNITION CABLE

BACKGROUND OF THE INVENTION

1. Field of the Invention

The present invention relates to a high voltage terminal for connecting an ignition cable to a terminal of approximately columnar shape such as an end terminal of an ignition plug.

2. Description of Background Information

Conventionally, the structure of the connecting part between the ignition cable and the ignition plug has been constituted as shown in FIG. 10.

According to this structure of the connecting part, an ignition plug P is fitted to the engine body E such that the insulator part Pg at the top of the ignition plug P projects upwardly. At the upper part of the insulator part Pg, a ball-topped, generally columnar end terminal Pt projects for receiving a secondary high voltage from the ignition coil. Also, a rubber boot 100 is provided to accommodate a high voltage terminal 110 at the end of the ignition cable K. The rubber boot 100 is engaged with the insulator part Pg of the ignition plug P, and inside the rubber boot the high voltage terminal 110 and the end terminal Pt are held in an electrically connected state. Furthermore, the rubber boot 100 is covered with a metal heat shielding member 105, thereby preventing thermal degradation of the rubber boot 100 by shielding radiating heat from a heat generation source such as exhaust pipe.

In the construction shown in FIG. 11, a high voltage terminal 110 is formed by continuous connection on a straight line, through a connecting part 116, of a tubular terminal 114 on one end of a channel-shaped, press-fit clamping part 112 having a projection 111 at the tip of both sides. Also, a portion of the continuous connecting part 116 and the bottom part of the terminal 114 are cut and deformed upwardly to form a contact piece 117 projecting between the press-fit clamping part 112 and the tubular terminal 114. When the end of the ignition cable K is accommodated in the press-fit clamping part 112 and its end is press-fitted to the contact piece 117, the press-fit clamping part 112 is deformed inwardly to press-fit the projection 111 in a manner to bite into the outer peripheral part of the ignition cable K, such that the high voltage terminal 110 is fixed to the ignition cable K end.

A generally C-shaped elastic C-ring member 118 is clipped onto the above terminal 114. This C-ring member 118 is formed in a manner to be fitted onto the terminal 114, as shown in FIG. 12, and on both sides of its inner peripheral surface are formed a pair of projections 119 which project inwardly. On the other hand, on the outer peripheries of both sides of the terminal 114 are formed a pair of stopping holes 115 within which the projections 119 may be engaged. By applying the C-ring member 118 to the terminal 114 in a manner to engage each projection 119 within each stopping hole 115, the C-ring member 118 is fixed to the high voltage terminal 110.

According to this construction of the high voltage terminal 110, by inserting the end terminal Pt of the ignition plug P into engagement with the terminal 114, the high voltage terminal 110 and the end terminal Pt of the ignition plug P are electrically connected.

In order to assemble the structure of the connecting part between the ignition cable K and the ignition plug P using the high voltage terminal 110 of such construction, when the rubber boot 100 is engaged in the insulator Pg of the ignition plug P, the end terminal Pt must be inserted deep within the high voltage terminal 110 for the connection to be sufficiently attained. However, if, for example, under the condition where the rubber boot 100 is engaged with the insulator Pg, and insertion of the end terminal Pt into the terminal 114 is shallow and their engagement is insufficient, there is a risk of accidental firing of the ignition plug or stoppage of engine due to a faulty electrical connection between the high voltage terminal 110 and the end terminal Pt. Even if the insertion of the end terminal Pt into the terminal 114 is not shallow, if the relative positions between the end terminal Pt and the terminal 114 are inadequate due to displacement or the like, the high voltage terminal 110 and the end terminal Pt may be abraded or vibrated by engine vibration and the like to cause unsatisfactory electric connection between the high voltage terminal 110 and the end terminal Pt, thereby providing a risk of accidental firing of the ignition plug or stoppage of engine.

In order to prevent the above drawbacks, it is necessary to provide improved dimensional precision of parts such as the rubber boot 100, the high voltage terminal 110, and the like, and improvement in precision of the assembly position of these parts, especially of the high voltage terminal 110 into the rubber boot 100, thereby inviting the total increase in cost of this structure and loss of assembly efficiency.

Accordingly, in conventional constructions to ensure electrical connection between the high voltage terminal 110 and the end terminal Pt, there are devices using spring members, as shown in FIG. 13 or FIG. 14.

In a high voltage terminal 140 shown in FIG. 13, a stopper 144 projecting inwardly on a peripheral wall of the generally tubular shaped terminal part 142 is formed over the entire periphery of the terminal part. On the other hand, the spring member 146 is formed at one end to have a portion with a larger diameter than the intermediate portion of the spring. The high voltage terminal 140 is configured so that, by pushing the spring member 146 into the terminal part 142, the enlarged diameter portion 146 a rides over the stopper 144 and is disposed on the opposite side of the stopper 144, so that the spring member 146 is fixedly received within the terminal part 142.

When an end terminal Pt is inserted in the terminal 142 of the high voltage terminal 140, the spring member 146 is compressed and forced to be pressed to the end terminal Pt, thereby allowing the electrical connection between the high voltage terminal 130 and the end terminal Pt to be made with greater assurance.

Japanese Utility Model Laid-open Publication HEI 5-66891 and U.S. Pat. No. 5,340,323 (which corresponds to the Japanese document) are noted as showing techniques related to the high voltage terminal of FIG. 13.

In a high voltage terminal 150 shown in FIG. 14, an insertion port 154 is formed on one side of the peripheral wall of the generally tubular terminal part 152. On the other hand, the C-ring member 158, which is clipped over the terminal 152 as shown in FIG. 14 and FIG. 15, is formed with a tongue piece 159 which can be inserted into the terminal part 152 through the insertion port 154. According to this construction, by clipping the C-ring member 158 over the terminal part 152 and inserting the tongue piece 159 into the terminal part 152 from the insertion port 154, the tongue piece 159 is inserted into a gap between the pitch of the spring member 156 to hold the end of the spring member 156 at a predetermined position in the terminal part 152.

With this high voltage terminal 150, in the same manner as in the situation of FIG. 13, when an end terminal Pt is inserted in the terminal part 152, the spring member 156 is compressed and forced in a manner to be pressed to the end terminal Pt, thereby allowing a more positive electric connection between the high voltage terminal 150 and the end terminal Pt.

Japanese Utility Model Laid-open Publication HE16-80295 and U.S. Pat. No. 5,421,736 (which corresponds to the Japanese document) are noted as showing techniques related to the high voltage terminal of FIG. 14.

However, in the high voltage terminal 140 shown in FIG. 14, the other end of the spring member 145 projects outward from the opening of the terminal 142 in the non-compressed state, so that, upon inserting the end terminal Pt of the ignition plug P into the terminal 142, the spring member 146 may be caught by the opening of the terminal 142 or the spring member 146 may be dislocated sideways.

In this case, it is still insufficient to configure the inside of terminal 142 to fully accommodate the spring member 146 so as to prevent the other end of the spring member 146 from projecting outside the terminal 142. This is because, in such a case, the spring member 146 must be pushed deep into the terminal 142 while being installed so that the large diameter part 146*a* of the spring member 146 runs over the stopper 144 of the terminal 142, and a specific jig is required that can be inserted into the terminal 142, with the result that the inserting work itself is a problem.

In the high voltage terminal 150 shown in FIG. 14, because the construction is configured to insert the tongue piece 159 of the C-ring member 158 into the gap between the pitches of the spring member 156, there may be times where the tongue piece 159 is inserted into an improper position in the gap between the pitches of the spring member 156, because the spring member 156 is fitted into the terminal 152 in an inclined position, or where the tongue piece 159 is not pressed into a portion of the pitch gap of the spring member 156, i.e., it is pressed into the spring member 156 itself which may result in deformation of the spring member 156. Consequently, the spring member 156 may be destroyed by vehicle vibration.

Accordingly, the present invention has been made to solve the problems described above, and an object is to provide a high voltage terminal for an ignition cable which makes it possible to easily and more accurately position a spring member within the terminal section in order to more positively provide electrical connection of an ignition plug with a generally columnar terminal, such as an end terminal.

SUMMARY OF THE INVENTION

In order to solve the problems noted above, a high voltage terminal for ignition cable according to a first aspect of the present invention includes a high voltage terminal for an ignition cable which is fixed to an end of the ignition cable and electrically connected to a generally columnar terminal of an ignition plug. The high voltage terminal includes a terminal body formed by linearly connecting in series a press-fit clamping part to be press-fitted to one end of the ignition cable and a tubular terminal for receiving and engaging with the generally columnar terminal. A contact piece is provided to project toward the inside of the connecting part, and a pair of stopping holes are formed on opposite sides of the tubular terminal position at or near the connecting part of the terminal. A spring member is provided at least at one end with a large diameter portion having a diameter larger than the diameter of the intermediate portion of the spring in the longitudinal direction thereof and configured to be received within the terminal part. An elastic C-ring member having a generally C-shaped body is provided with a pair of projections on opposite sides of the inner peripheral surface of the C-ring body which can be engaged within the stopping holes, respectively. Thus, by engaging the projections of the elastic C-ring member with the respective stopping holes, the large diameter portion of the spring is retained within the terminal part at a predetermined position between the contact piece and the projections.

Alternatively, in another aspect of the present invention, both ends of the spring member may be provided with large diameter portions having a larger diameter than the diameter of the intermediate portion in the longitudinal direction thereof.

According to another aspect of the present invention, the large diameter portions of the spring member may be provided with outwardly extending small diameter contact portions having a diameter smaller than that of the generally columnar terminal of the ignition plug.

In another aspect of the present invention, a high voltage terminal is provided for an ignition cable which is fixable to an end of the ignition cable and electrically connectable to a generally columnar terminal. The high voltage terminal includes a terminal body including a connecting part having a press-fit clamping portion configured to be press-fitted onto an end of the ignition cable and a tubular terminal configured to receive and engage the generally columnar terminal. The tubular terminal includes a contact piece provided to project inwardly of the connecting part, and a pair of stopping holes, each stopping hole being formed on an opposite side of the tubular terminal at a position adjacent the connecting part. The high voltage terminal further includes a spring member having at least at one end provided with a large diameter portion having a diameter larger than a diameter of an intermediate portion in a longitudinal direction thereof, the spring member configured to be positioned within the tubular terminal, and an elastic C-ring member having a pair of projections on an inner peripheral surface thereof, the projections being engageable with the stopping holes respectively on opposite sides of the tubular terminal, so that when the projections are engaged within the stopping holes, respectively, the large diameter portion of the spring is retained in a position within the tubular terminal and between the contact piece and the projections. Additionally, the contact piece may be bent inwardly from the tubular terminal to extend substantially perpendicular to a longitudinal axis of the tubular terminal.

In a further aspect of the present invention, the spring member of the high voltage terminal for an ignition cable includes a configuration having the relationship $R_2<R_B<R_1$, wherein $R_B$ represents a spacing between the projections of C-ring member;

$R_1$ represents the diameter of said large diameter portion of the spring member; and $R_2$ represents the diameter of said intermediate portion of said spring member.

In still another aspect of the present invention, both ends of the spring member are provided with large diameter portions having a larger diameter than the diameter of the intermediate portion in the longitudinal direction thereof Additionally, an outermost end portion of at least one the large diameter portion is provided with a small diameter contact portion having a diameter smaller than that of the generally columnar terminal for engagement therewith. Alternatively, an outermost end portion of both large diameter portions are provided with a small diameter portion.

BRIEF DESCRIPTION OF THE DRAWINGS

The above and other features and advantages of the present invention will be made apparent from the following description of the preferred embodiments, given as non-limiting examples with reference to the accompanying drawings, in which:

FIG. 5(*b*) is a side view of the C-ring member of FIG. 5(*a*);

FIG. 12(*b*) is a side view of the C-ring member of FIG. 12(*a*);

DETAILED DESCRIPTION OF THE INVENTION

Figure 1:
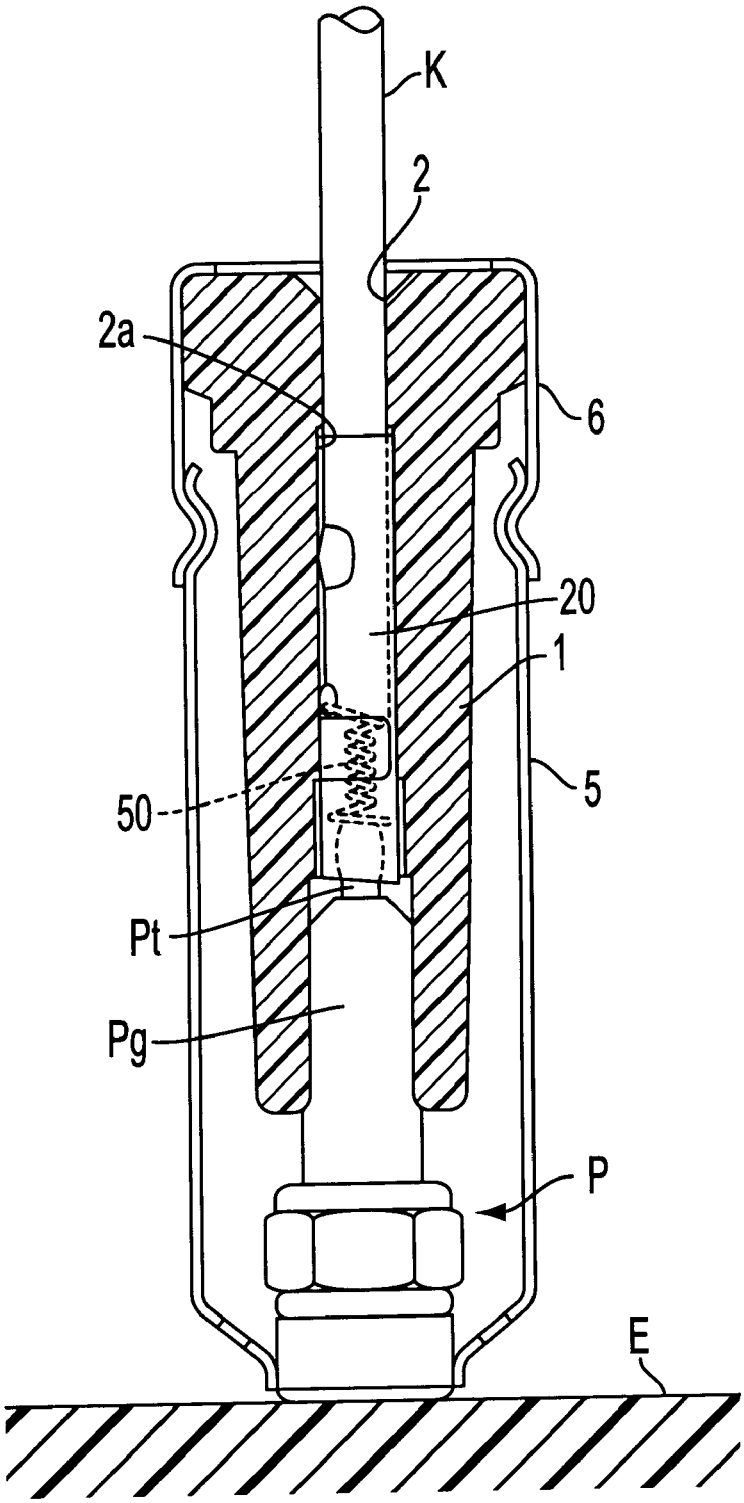
FIG. 1 is a sectional view showing a construction of a connecting part between an ignition cable and an ignition plug to which a high voltage terminal for an ignition cable is applied according to a first embodiment of the present invention.

Hereinafter, a first embodiment of the present invention will be described. FIG. 1 shows a sectional view of the structure of the connecting part between the ignition cable K and the ignition plug P to which the high voltage terminal 20 for an ignition cable according to the present invention is applied. This high voltage terminal 20 for an ignition cable can be applied not only to the end terminal Pt of the ignition plug P but also may be used in connecting with other generally columnar terminals, e.g., generally columnar terminals on the distributor side, and the like.

According to the structure of this connecting part, the ignition plug P is fixed to the engine body E with the insulator Pg projecting from the upper end thereof A ball-topped, generally columnar end terminal Pt projects from the upper end of the insulator Pg for application of the secondary high voltage from the ignition coil. A high voltage terminal 20 of an ignition cable K is provided within a generally tubular rubber boot 1. The high voltage terminal 20 is held in position at a predetermined position by engagement of the top end face thereof with a downwardly extending step 2*a* formed on the inner peripheral face of the insertion hole 2 in the rubber boot 1. Also, the lower end of the rubber boot 1 is engaged with the insulator Pg of the ignition plug P and the high voltage terminal 20 and the end terminal Pt are held under an electrically connected state. The rubber boot 1 is covered with a metal heat shielding member 5 and a heat shielding cap 6, by which the radiation heat from a heat generation source, such as an exhaust pipe, is shielded to prevent thermal degradation of rubber boot 1.

Hereinafter, details of the high voltage terminal 20 will be described.

Figure 2:
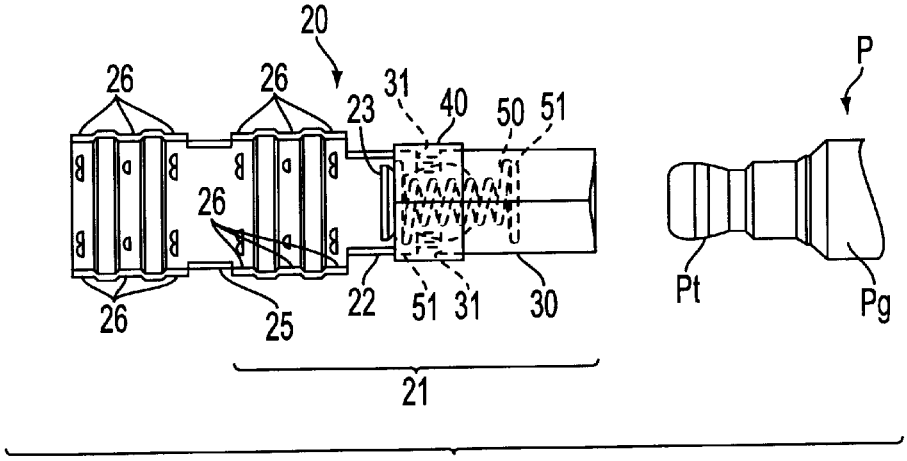
FIG. 2 is a plan view showing the high voltage terminal for an ignition cable according to the first embodiment of the present invention.
Figure 3:
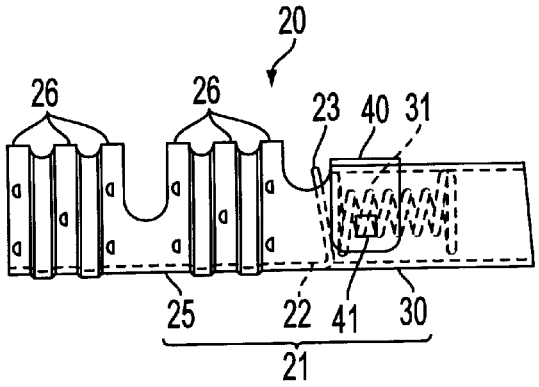
FIG. 3 is a side view showing the high voltage terminal for the ignition cable of FIG. 2.

The high voltage terminal 20, as shown in FIG. 2 and FIG. 3, is provided with a generally linear terminal body 21 configured to include a press-fit clamping part 25 and a generally tubular terminal 30 joined by a connecting part 22. A spring member 50 is provided within the tubular terminal part 30, and an elastic C-ring member 40 is positioned over the tubular terminal part 30.

The press-fit clamping part 25 is formed in a generally U-shaped configuration, and a plurality of corrugations 26 are formed at the tips on both sides thereof. The construction is such that, under the condition that the end of the ignition cable K is accommodated in the press-fit clamping part 25, the press-fit clamping part 25 is deformed inwardly to cause the corrugations 26 to wedge into the covering of the ignition cable K, so that the high voltage terminal 20 is press-fitted and clamped to the end of the ignition cable K.

The terminal 30 is formed to have a generally a tubular shape into which an end terminal Pt of an ignition plug can be inserted. Furthermore, a pair of stopping holes 31 are formed on opposite sides of the terminal at a position adjacent the connecting part 22 of the terminal 30 which engage with a pair of projections 42 of the C-ring member 40 in a manner to be described later.

On a portion of the bottom of the connecting part 22 and the terminal 30, a generally U-shaped notch is provided, and the notched portion is bent upwardly in a generally vertically direction into the connecting part 22 to form a contact piece 23 in projection (as seen in FIGS. 2 and 3). A core wire (illustration omitted) which is exposed at the end of the ignition cable K is turned back along the covered portion, and the end face of the ignition cable is applied in a manner to press against the contact piece 23. Thereafter, the end of the ignition cable K is press-fitted to the press-fit clamp part 25 to obtain electrical connection between the core wire of the ignition cable K and the high voltage terminal 20.

Figure 4:
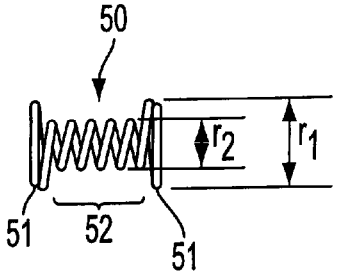
FIG. 4 is a side view showing a spring member according to the first embodiment of the present invention.

The spring member 50 is formed, as shown in FIG. 2 to FIG. 4, into a coil spring shape which can be deformed by compression, and both ends of which are configured to have large diameter portions 51 with a larger diameter than that of the intermediate part 52, in the longitudinal direction. The length of the spring member 50 is configured to be smaller than the distance between each stopping hole 31 and the open end of the terminal 30 (the right end of the terminal 30 as seen in FIGS. 2 and 3), and the diameters of the large diameter portions 51 at both ends of the spring member 50 are configured to be smaller than the inner diameter size of the terminal 30. The construction of spring member 50 is such that the large diameter portion 51 on one end thereof is retained in position between the projections 42 of C-ring 40 and the contact piece 23, in a manner to be described later, such that the spring member 50 can be retained within the terminal 30.

Figure 5A:
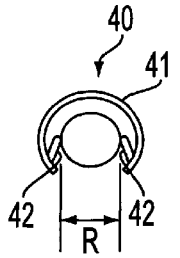
FIG. 5(*a*) is a front view of one embodiment of a C-ring member.
Figure 5B:
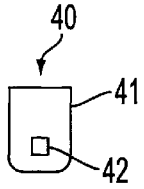

With respect to the C-ring 40, as shown in FIG. 2, FIG. 3 and FIGS. 5(*a*) and (*b*), predetermined portions at both ends of the C-ring body 41 are slit in a generally U-shape. The slit portions are bent to the inside of the C-ring body 41, by which a pair of projections 42 are formed to project opposite each other on the inner peripheral surface of the C-ring body 41. Each projection 42 is configured to be engaged with a respective stopping hole 31 of the terminal 30, so that the C-ring member 40 can be clipped onto the terminal part 30.

Additionally, when each projection 42 is engaged with each stopping hole 31, the tip of each projection 42 projects into the terminal 30. Furthermore, when the spring member 50 is accommodated in the terminal 30 and one end of the spring member 50 is brought into direct contact with the contact piece 23, upon clipping the C-ring member 40 onto the terminal 30, the large diameter portion 51 at the one end of the spring member 50 is accommodated in the terminal 30 in a retained position between the contact piece 23 and the tips of the projections 42 which project into the terminal 30.

In order to explain the conditions such that the large diameter portion 51 on the one end of the spring member 50 is retained in position between the contact piece 23 and the tips 42 in a more positive manner, the conditions set forth as follows apply. Namely, assuming the diameter of the large diameter portion 51 to be $r^1$, and the diameter of the intermediate portion in the longitudinal direction thereof to be $r^2$ (as shown in FIG. 4), and the gap between the projections 41 of the C-ring member 40 to be R (as shown in FIG. 5), the dimensions of $r^1$, $r^2$, and R are required to satisfy the conditions such that $r^2<R<r^1$.

Accordingly, the high voltage terminal 20 is assembled by inserting the spring member 50 into the terminal 30 of the terminal body 21 so that the one end face of the spring member 50 directly contacts the contact piece 23. Then, the C-ring member 40 is clipped onto the terminal 30, and each projection 42 of the C-ring member 40 is engaged within a respective stopping hole 31.

With the structure of the connecting part between the ignition cable having the high voltage terminal 20 and the ignition plug P described above, connection between the high voltage terminal 20 and the terminal Pt of the ignition plug P is performed in the following manner.

That is to say, as shown in FIG. 1, an insulator Pg of the ignition plug P is inserted under pressure for engagement into the lower end of the rubber boot 1 accommodating the high voltage terminal 20 which is fitted to the end of the ignition cable K. Thus, the end terminal Pt at the upper end of the insulator Pg is inserted into the insulator 30 of the high voltage terminal 30. By this operation, the tip of the end terminal Pt is brought into direct contact with the second end of the spring member 50, and the spring member 50 is compressed in the terminal 30. As a result, the spring member 50 is interposed under a compressed condition between the contact piece 23 and the end terminal Pt.

According to the high voltage terminal 20 as described above, firstly, when the end terminal Pt is inserted to fit into the terminal 30, the spring member 50 is compressed between the end terminal Pt and the contact piece 23, by which a more positive electrical contact between the high voltage terminal 20 and the end terminal Pt is realized through a spring member 50.

Further, in fitting the spring member 50, when the spring member 50 is accommodated in the terminal 30 and the C-ring member 40 is clipped onto the terminal 30, each projection 42 of the C-ring member 40 is engaged with a respective stopping hole 31 of the terminal 30. The tip of each projection 42 projects into the terminal 30, so that the large diameter portion 51 of the spring member 50, is retained and held in the terminal 30 between the contact piece 23 and each projection 42. By this operation, mounting of the spring member 50 is facilitated.

Figure 14:
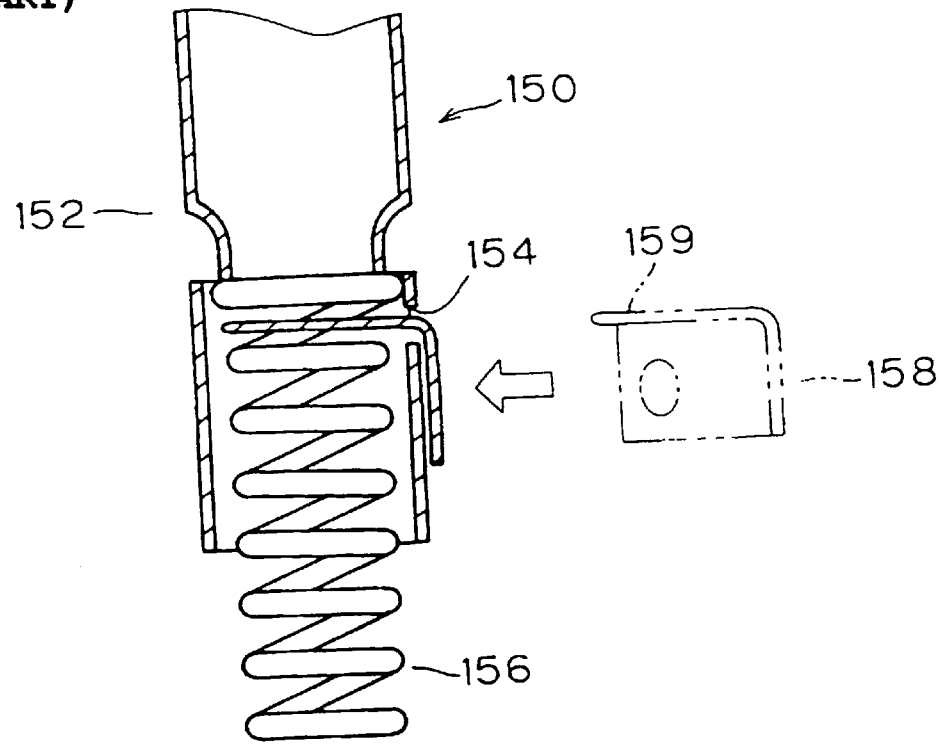
Fig. 14 (PRIOR ART)
FIG. 14 is an enlarged sectional view showing an essential part of another conventional high voltage terminal for an ignition cable.
Figure 15A:
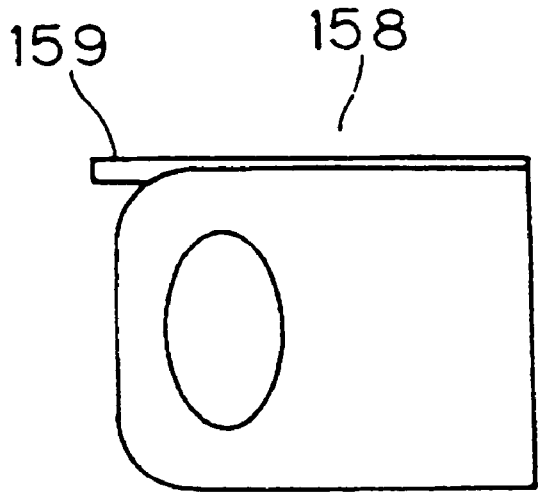
Fig. 15(a) (PRIOR ART)
FIG. 15(*a*) is a side view showing a C-ring member for a high voltage terminal for the ignition cable shown in FIG. 14, and FIG. 15(*b*) is a plan view of the C-ring member of FIG. 15(*a*).
Figure 15B:
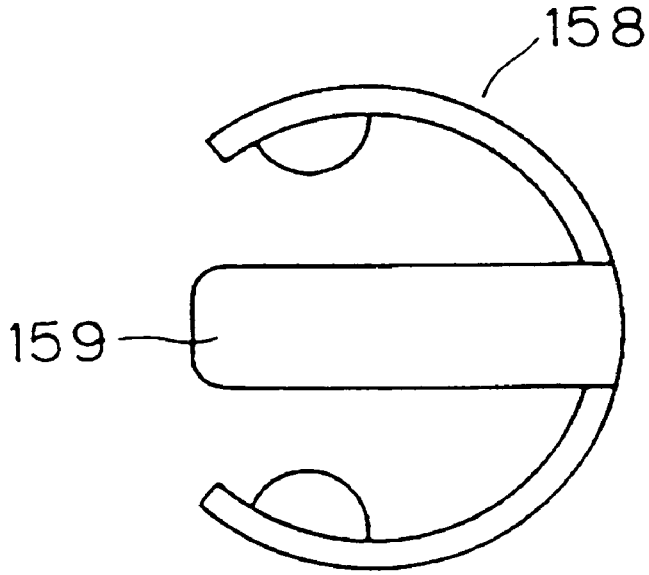
Fig. 15(b) (PRIOR ART)

In the conventional embodiment shown in FIG. 14, there may be cases where the tongue piece 159 of the C-ring member 158 interferes with the spring member 156 per se to cause it to be deformed or to be fitted in an inclined position. However, with the high voltage terminal 20 of the present invention, such a problem is less likely to occur, because the large diameter portion 51 of the spring member 50 is fixed in a position between the tip of each projection 42 of the C-ring member 40, which project into the terminal 30, and the contact piece 23, and the spring member 50 can be mounted in a more accurate position.

Considering the construction necessary to accommodate and hold the spring member 50 in the terminal 30 with the large diameter portion 51 being fixed between the contact piece 23 and the projection 42, it may be desirable to provide only one end of the spring member 50 with an enlarged diameter portion 51. Of course, if both ends of the spring member 50 are provided with the large diameter portions 51, then it becomes possible to insert the spring member 50 into the terminal 30 regardless of the orientation of the spring ends relative to the contact piece 23, thereby providing excellent ease of assembling the high voltage terminal 20.

Figure 6A:
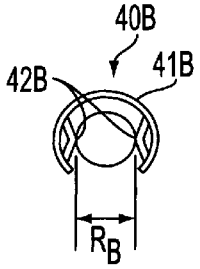
FIG. 6(*a*) is a front view of a C-ring member according to a second embodiment, and FIG. 6(*b*) is a side view of the C-ring member in the second embodiment.
Figure 6B:
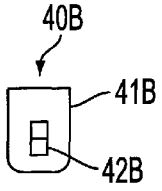

In another embodiment of the present invention, the C-ring member 40 may be formed as shown in FIG. 6. In this embodiment, the C-ring member 40B is formed such that the predetermined portions at each end of the C-ring body 41B are slit in a pair of parallel lines along the peripheral direction, and the slit portions are bent inwardly in a generally V-shape toward the inside of the C-ring body 41B, thereby forming a pair of projections 42B opposed to one another on the inner peripheral surface of the C-ring body 41B. These projections 42B are also configured to engage within the stopping holes 31 respectively, so that the C-ring member 40B may be clipped onto the terminal 30. In the case of the C-ring member 40B, assuming the size of the space between the adjacent projections of C-ring member 40 to be $R_B$, it is necessary for the following relations to be satisfied between the diameter $R_1$ of the large diameter portion 51 of the spring member 50 and the diameter $R_2$ of the intermediate portion in the longitudinal direction (see FIGS. 4 and 6):$R_2<R_B<R_1$.

Figure 7:
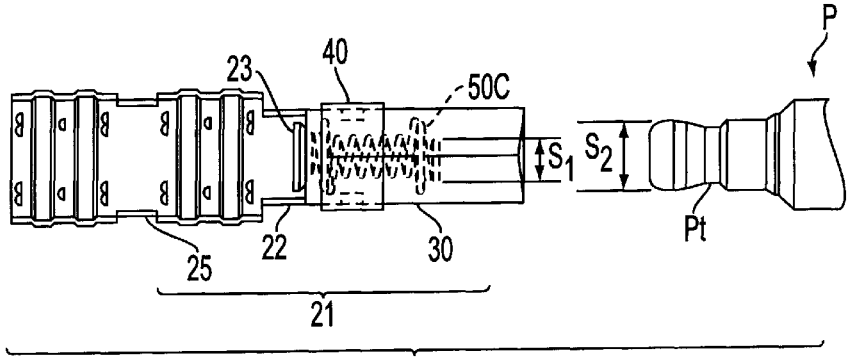
FIG. 7 is a plan view showing a high voltage terminal in a modified embodiment.
Figure 8:
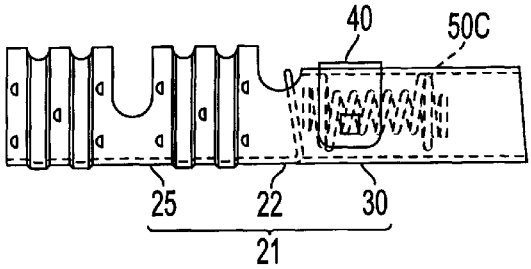
FIG. 8 is a side view showing a high voltage terminal in the modified embodiment of FIG. 7.
Figure 9:
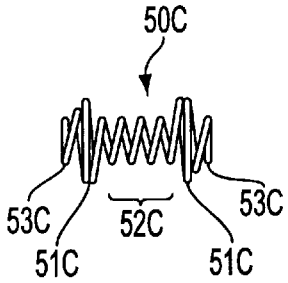
FIG. 9 is a side view showing a spring member in the modified embodiment of FIGS. 7 and 8.
Figure 10:
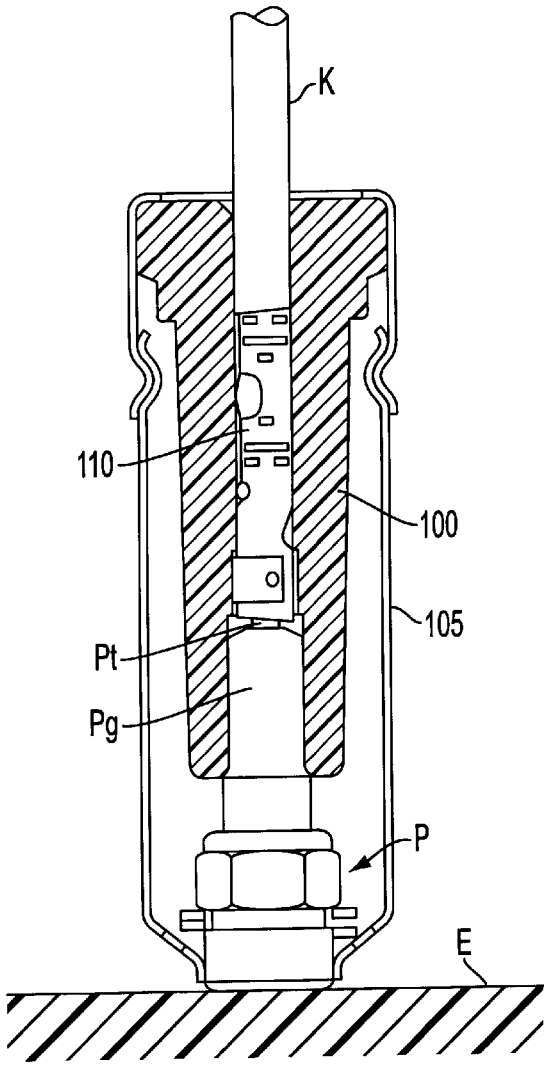
FIG. 10 (PRIOR ART)
FIG. 10 is a sectional view showing a conventional connecting part between an ignition cable and an ignition plug.
Figure 11A:
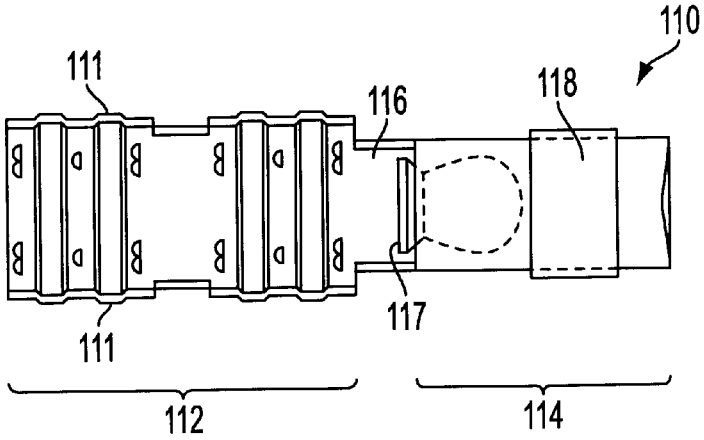
FIG. 11A (PRIOR ART)
FIG. 11(*a*) is a plan view showing the conventional high voltage terminal for an ignition cable of FIG. 10, and FIG. 11(*b*) is a side view showing the conventional high voltage terminal for an ignition cable of FIG. 11(*a*)
Figure 11B:
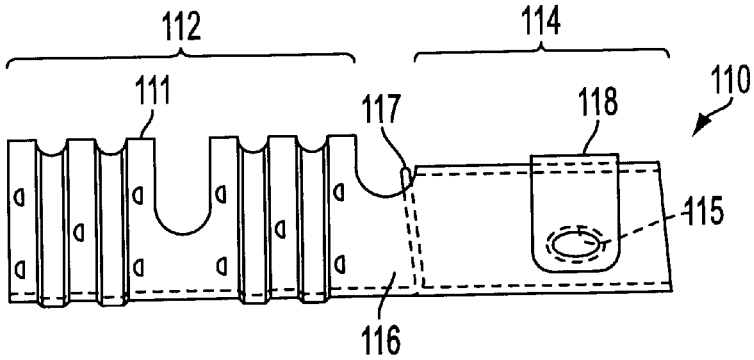
FIG. 11B (PRIOR ART)
Figure 12A:
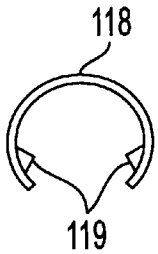
FIG. 12A (PRIOR ART)
FIG. 12(*a*) is a plan view of a conventional C-ring member.
Figure 12B:
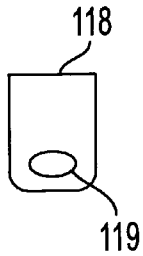
FIG. 12B (PRIOR ART)
Figure 13:
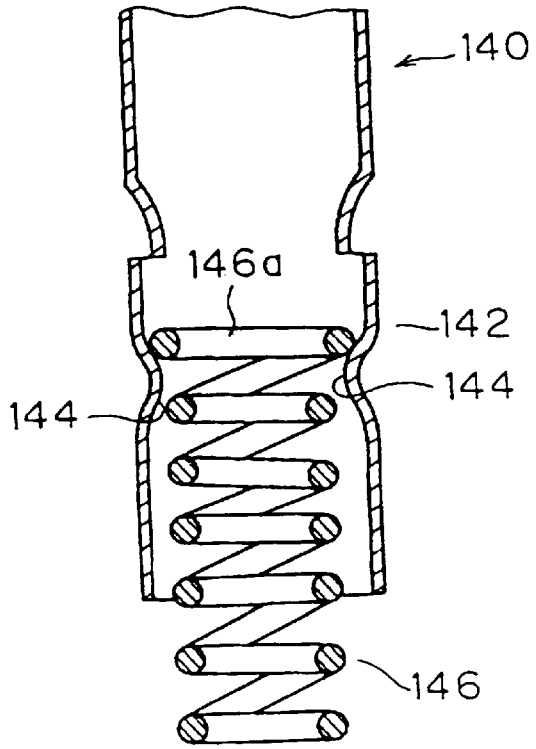
Fig. 13 (PRIOR ART)
FIG. 13 is an enlarged sectional view of an essential part showing a conventional high voltage terminal for an ignition cable.

The spring member 50 may also be formed as in the modified embodiment shown in FIGS. 7 to 9.

The spring member 50C is provided at its both ends with large diameter portions 51C having a larger diameter than the diameter of the intermediate part 52C in the longitudinal direction. Furthermore, portions outwardly of the large diameter portions 51C are configured into small diameter contact portions 53C having a diameter $S_1$ which is smaller than the diameter $S_2$ of the end terminal Pt of the ignition plug P (see FIG. 7). Additionally, the construction is such that, at the time when the end terminal Pt is pressed to engage either end of the spring member 50C, the end terminal Pt does not enter into the spring member 50C but makes positive contact securely with the small diameter portion 53C.

The spring member 50C is accommodated and arranged in the terminal 30 such that one end thereof is brought into direct contact with the contact piece 23, and when the C-ring member 40 is clipped onto the terminal 30, the large diameter portion 51C at the one end is retained and held in the terminal 30 in a fixed position between the contact piece 23C and the projection 42 of the C-ring member. Furthermore, when the end terminal Pt is inserted into the terminal 30 under such condition, the end terminal Pt makes positive contact with the small diameter contact portion 53C of the spring member 50C on the other end, thereby providing excellent reliability of the electrical connection between the high voltage terminal 20 and the end terminal Pt.

As described above, according to a high voltage terminal for an ignition cable of the present invention, a high voltage terminal for the ignition cable includes a terminal body formed by linearly connecting in series a press-fit clamping part to be press-fitted to an end of the ignition cable and a tubular terminal for receiving and engaging a generally columnar terminal. A contact piece is provided to project toward the inside of the connecting part, and a pair of stopping holes are formed on opposite sides at a position near the connecting part of the terminal. A spring member is provided, at least at one end, with a large diameter portion having a diameter larger than the diameter of an intermediate portion in the longitudinal direction thereof. The spring member is configured to be accommodated within the terminal part. Furthermore, an elastic C-ring member is provided and configured to have a pair of projections which are engageable with the stopping holes respectively on opposite sides of the contact piece are provided on the inner peripheral surface of the C-ring body. Accordingly, the C-ring member is clipped to the contact piece, thereby engaging the projections with the stopping holes respectively, and the large diameter portion of the spring is retained within the terminal part at a fixed position between the contact piece and the projections. Thus, when the generally columnar terminal is inserted to engage within the high voltage terminal, the spring member is positioned between the generally columnar terminal and the contact piece in a compressed condition, thereby allowing a more reliable electrical connection to be made between the high voltage terminal and the generally columnar terminal.

Accordingly, mounting of the spring member is easy, and, when the C-ring member is clipped on the terminal, each projection thereof is engaged with a respective stopping hole of the terminal so that the tip of each projection projects into the terminal. Therefore, under the condition where the large diameter portion of the spring member is positioned between the contact piece and the projections, the spring member is fixedly held in the terminal section, thus allowing easy mounting of the spring member.

Also, since the spring member is mounted inside the terminal with the large diameter portion fixed in a position between the projections of the C-ring member and the contact piece, it is unlikely that the tips of the projections will interfere with the spring member per se to cause the spring member to be fitted in an inclined position or to be deformed, and accordingly it is possible to mount the spring member in a more accurate position.

Furthermore, when both ends of the spring member are provided with portions having a larger diameter than the diameter of the intermediate part in the longitudinal direction thereof, and the end of the spring member which comes into contact with the generally columnar terminal includes a small diameter contact part having a diameter smaller than the diameter of the generally columnar terminal described above, ease of assembly and superior reliability of the electrical connection between the high voltage terminal and the generally columnar terminal results.

Although the invention has been described with reference to particular means, materials, and embodiments, it is to be understood that the invention is not limited to the particulars disclosed and extends to all equivalents within the scope of the claims.

The present disclosure relates to subject matter contained in priority Japanese Application No. HEI 10-325098, filed on Nov. 16, 1998, which is herein expressly incorporated by reference in its entirety.

What is claimed is:

1. A high voltage terminal for an ignition cable which is fixable to an end of the ignition cable and electrically connectable to a generally columnar terminal, comprising:

a terminal body including a connecting part having a press-fit clamping portion configured to be press-fitted onto an end of the ignition cable and a tubular terminal configured to receive and engage the generally columnar terminal, said tubular terminal including a contact piece projecting inwardly of said connecting part, and a pair of stopping holes, each stopping hole formed on an opposite side of said tubular terminal at a position adjacent said connecting part;

a spring member having at least at one end provided with a large diameter portion having a diameter larger than a diameter of an intermediate portion in a longitudinal direction thereof, said spring member configured to be positioned within said tubular terminal; and an elastic C-ring member having a pair of projections on an inner peripheral surface thereof, said projections being engageable with said stopping holes respectively on opposite sides of said tubular terminal, so that when said projections are engaged within said stopping holes, respectively, said projections engage only said large diameter portion of said spring to retain said large diameter portion in position within said tubular terminal and between said contact piece and said projections.

2. The high voltage terminal for an ignition cable according to claim 1, wherein said contact piece is formed unitarily and in one piece with said tubular and is bent inwardly from said tubular terminal and extends substantially perpendicular to a longitudinal axis of said tubular terminal.

3. The high voltage terminal for an ignition cable according to claim 1, wherein said spring member comprises a configuration having the relationship $R_2<R_B<R_1$, wherein $R_B$ represents a spacing between the projections of C-ring member;

$R_1$ represents the diameter of said large diameter portion of the spring member; and $R_2$ represents the diameter of said intermediate portion of said spring member.

4. A high voltage terminal for an ignition cable which is fixable to an end of the ignition cable and electrically connectable to a generally columnar terminal, comprising:

a terminal body including a connecting part having a press-fit clamping portion configured to be press-fitted onto an end of the ignition cable and a tubular terminal configured to receive and engage the generally columnar terminal, said tubular terminal including a contact piece provided to project inwardly of said connecting part, and a pair of stopping holes, each stopping hole formed on an opposite side of said tubular terminal at a position adjacent said connecting part;

a spring member having at least at one end provided with a large diameter portion having a diameter larger than a diameter of an intermediate portion in a longitudinal direction thereof, said spring member configured to be positioned within said tubular terminal;

an elastic C-ring member having a pair of projections on an inner peripheral surface thereof, said projections being engageable with said stopping holes respectively on opposite sides of said tubular terminal, so that when said projections are engaged within said stopping holes, respectively, said large diameter portion of said spring is retained in a position within said tubular terminal and between said contact piece and said projections; and wherein both ends of said spring member are provided with large diameter portions having a larger diameter than the diameter of the intermediate portion in the longitudinal direction thereof.

5. The high voltage terminal for an ignition cable according to claim 4, wherein an outermost end portion of at least one said large diameter portion is provided with a small diameter contact portion having a diameter smaller than that of the generally columnar terminal for engagement therewith.

6. The high voltage terminal for an ignition cable according to claim 5, wherein an outermost end portion of both said large diameter portions is provided with a small diameter portion.

7. The high voltage terminal for an ignition cable according to claim 1, wherein both ends of said spring member are provided with large diameter portions having a larger diameter than the diameter of the intermediate portion in the longitudinal direction thereof.

8. The high voltage terminal for an ignition cable according to claim 7, wherein an outermost end portion of at least one said large diameter portion is provided with a small diameter contact portion having a diameter smaller than that of the generally columnar terminal for engagement therewith.

9. The high voltage terminal for an ignition cable according to claim 8, wherein an outermost end portion of both said large diameter portions is provided with a small diameter portion.

* * * * *

UNITED STATES PATENT AND TRADEMARK OFFICE

CERTIFICATE OF CORRECTION

PATENT NO. : 6,206,709 B1
DATED : March 27, 2001
INVENTOR(S) : Takohito Uchiyama It is certified that error appears in the above-identified patent and that said Letters Patent is hereby corrected as shown below:

Column 10,
Line 49, after the word "tubular" insert the word -- terminal --

Signed and Sealed this

Twenty-third Day of April, 2002

*Attest:*

*Attesting Officer*

JAMES E. ROGAN
*Director of the United States Patent and Trademark Office*